US008500323B2

(12) United States Patent
Zaugg et al.

(10) Patent No.: US 8,500,323 B2
(45) Date of Patent: Aug. 6, 2013

(54) TIMEPIECE INCLUDING A HIGH FREQUENCY MECHANICAL MOVEMENT

(75) Inventors: Alain Zaugg, Le Brassus (CH); Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 232 days.

(21) Appl. No.: 13/039,917

(22) Filed: Mar. 3, 2011

(65) Prior Publication Data

US 2011/0216629 A1 Sep. 8, 2011

(30) Foreign Application Priority Data

Mar. 4, 2010 (EP) ..... 10155490

(51) Int. Cl.
*G04B 15/00* (2006.01)

(52) U.S. Cl.
USPC ..... 368/132

(58) Field of Classification Search
USPC ..... 368/124–138, 140, 147–151, 206, 368/207, 208
See application file for complete search history.

(56) References Cited

U.S. PATENT DOCUMENTS 6,301,981 B1 * 10/2001 Oechslin ..... 74/1.5
6,402,368 B1 * 6/2002 Grimm et al. ..... 368/127
7,708,455 B2 5/2010 Cabezas Jurin et al.
2007/0147179 A1 * 6/2007 Girardin et al. ..... 368/147
2008/0259738 A1 10/2008 Cabezas Jurin et al.
2009/0168610 A1 * 7/2009 Gigandet et al. ..... 368/127

FOREIGN PATENT DOCUMENTS

EP 1 983 388 A1 10/2008
EP 2 075 651 A1 7/2009
EP 2 107 434 A1 10/2009
EP 2 230 570 A2 9/2010
WO 2004/029733 A2 4/2004

OTHER PUBLICATIONS

Search Report issued in corresponding European application No. 10155490, completed Aug. 20, 2010.

Genolet, Gregoire et al.,"Nouvelles fonctionnalites pour pieces horlogeres donnees par la technologie LiG(A)", Technologie de fabrication, Bulletin SSC No. 46, Sep. 2004, pp. 19-22.

* cited by examiner

*Primary Examiner* — Edwin A. Leon
(74) *Attorney, Agent, or Firm* — Griffin & Szipl, P.C.

(57) ABSTRACT

The invention pertains to the field of high frequency watch movements. The invention relates to a timepiece including a movement that has a resonator of the type with a balance and balance spring and an escape system of the type with a wheel and Swiss lever. According to the invention, the balance oscillates at more than 36,000 vibrations per hour and the escape system is at least partially pierced to decrease the inertia thereof.

18 Claims, 4 Drawing Sheets

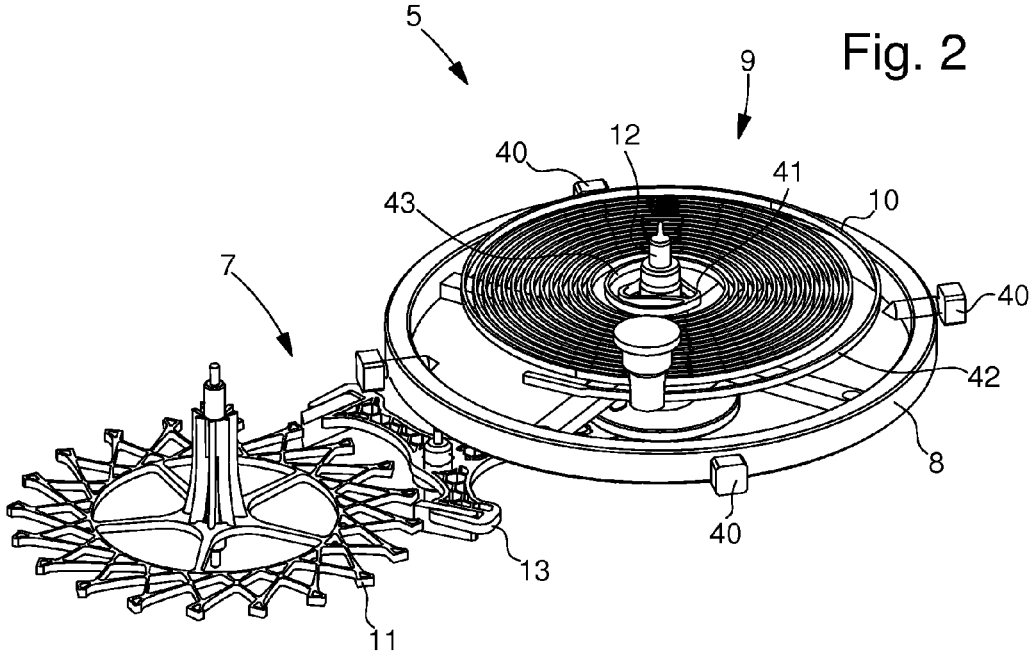
Fig. 2
Fig. 3
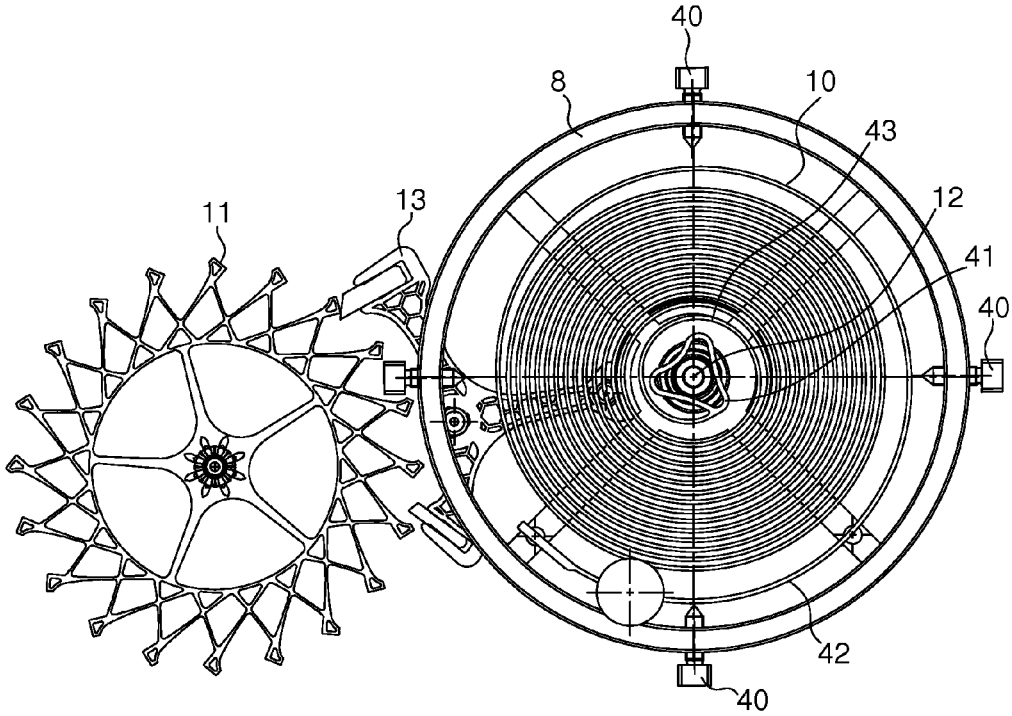

TIMEPIECE INCLUDING A HIGH FREQUENCY MECHANICAL MOVEMENT

This application claims priority from European Patent Application No. 10155490.5 filed Mar. 4, 2010, the entire disclosure of which is incorporated herein by reference.

FIELD OF THE INVENTION

The invention relates to a timepiece whose chronometric performance is improved and, more specifically, whose mechanical movement is capable of operating at 72,000 vibrations per hour, i.e. at a frequency of 10 Hz.

BACKGROUND OF THE INVENTION

Fabricating movements that operate at 5 Hz so as to improve the precision of timepieces is known. However, it becomes very difficult to develop a mechanism capable of oscillating beyond this frequency because of the balance speeds generated and the profound alterations to be made.

Document EP 2 075 651 proposes making a movement operating at more than 5 Hz while observing a ratio between the number of escape wheel teeth and the frequency equal to 5. This Patent document thus discloses the necessity, for a 10 Hz movement, of using an escape wheel with fifty teeth while still keeping the same diameter. The fabrication of fifty teeth with the same diameter constitutes a significant constraint which makes implementation and development difficult with conventional gear trains.

SUMMARY OF THE INVENTION

It is an object of this invention to overcome all or part of the aforecited drawbacks by proposing a timepiece whose escape system allows an increase in the balance oscillation frequency by altering a limited number of parts of the movement and therefore improves the chronometric performance of the movement.

The invention therefore relates to a timepiece that includes a movement having a balance and balance spring type resonator and a wheel—Swiss lever escape system, characterized in that the balance oscillates at more than 36,000 vibrations per hour and in that the escape system is at least partially pierced, so as to decrease its inertia, and includes an escape wheel with less than 25 teeth.

Thus, by decreasing the inertia of the escape system, it is possible to conserve a "conventional" movement architecture, i.e., for example, an escape wheel with 20 teeth and/or a usual number of wheel sets even when the balance oscillates at 72,000 vibrations per hour.

In accordance with other advantageous features of the invention:

- the balance oscillates at 72,000 vibrations per hour;
- the wheel of the escape system includes a main projecting face whose surface density is less than 0.7 mg.mm$^{-2}$;
- the wheel is pierced at the toothing and/or felloe thereof;
- the pierced wheel forms substantially triangular frames each supporting one tooth, the base being formed by the inner diameter of the felloe and connecting the tooth associated therewith by two sides;
- each frame is imbricated with the other two adjacent frames;
- the first of the two sides of each frame is secant with the second side of the preceding frame and the second side is secant with the first side of the following frame;

- the second side of the preceding frame joins the first side of the following frame substantially in the middle of the base of the frame.
- each frame surrounds a substantially quadrilateral shaped recess and two substantially triangular piercings;
- the wheel of the escape system includes twenty teeth;
- the wheel is formed from monocrystalline silicon coated with silicon dioxide;
- the Swiss lever of the escape system includes a main projecting face whose surface density is less than 1 mg.mm$^{-2}$;
- the Swiss lever is pierced forming a honeycomb type structure to preserve the mechanical resistance thereof;
- the pallet-stones of the Swiss lever are formed of rubies;
- the Swiss lever is formed from monocrystalline silicon coated with silicon dioxide;
- at least one part of the escape system includes an outer coating to alter the tribology and/or mechanical features thereof;
- the balance is of the variable inertia type;
- the seconds wheel of the movement is mounted to complete one revolution in 30 seconds to simplify the gear train of said movement.

BRIEF DESCRIPTION OF THE DRAWINGS

Other features and advantages will appear clearly from the following description, given by way of non-limiting indication, with reference to the annexed drawings, in which:

FIG. 2 is a perspective view of a resonator and an escape system according to the invention;

FIG. 3 is a top view of FIG. 2;

DETAILED DESCRIPTION OF PREFERRED EMBODIMENTS

Figure 1:
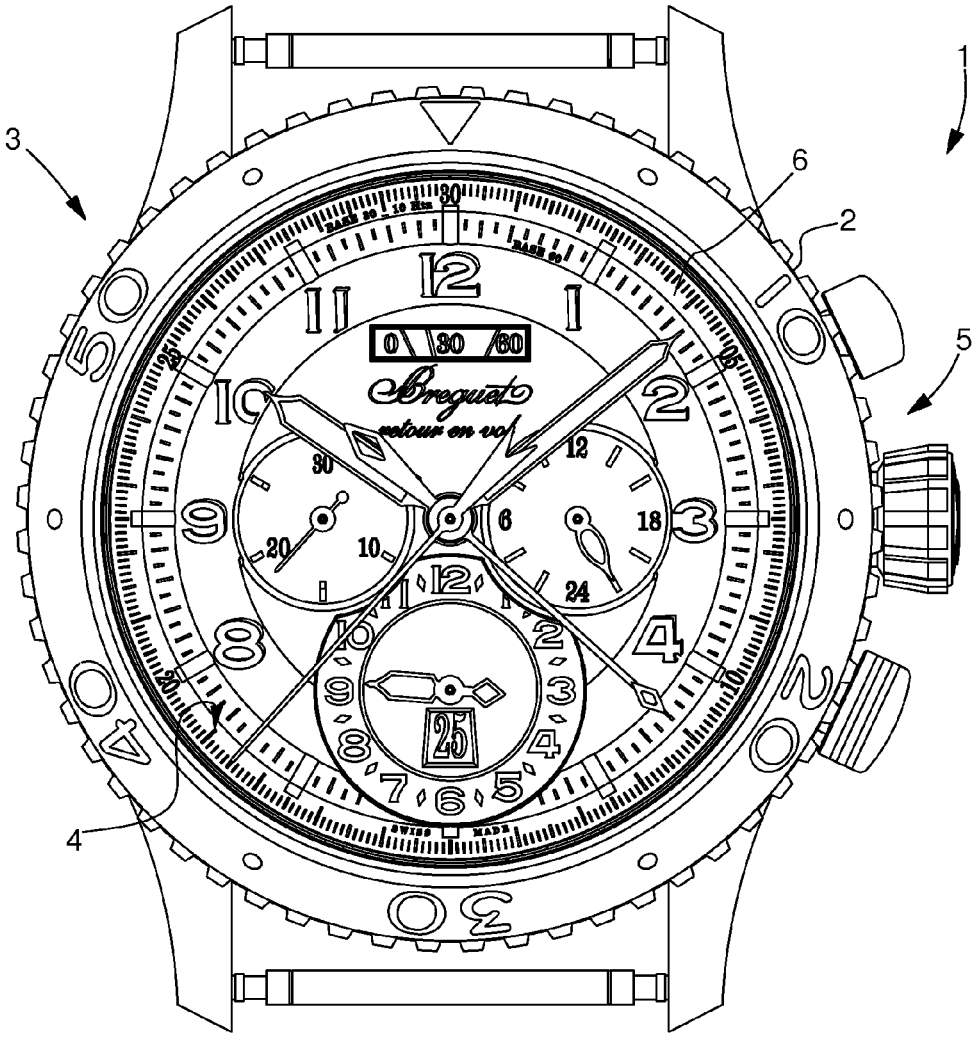
FIG. 1 is a face view of a timepiece according to the invention.

As illustrated in FIG. 1, a timepiece generally referenced 1 can be seen. It includes a case 3 including a middle part 2 closed by a back cover (not shown) and a crystal 4 and which is intended to receive a mechanical movement 5 between said back cover and the dial 6 of timepiece 1. As visible in FIG. 1, timepiece 1 includes several complications.

Thus, watch movement 5 is capable of displaying the current time (hour, minute, small seconds located at 9 o'clock completing one revolution in 30 seconds and an indicator that indicates whether the small seconds is between 0 and 30 seconds or between 30 and 60 seconds, located at 12 o'clock), but also a calendar (located at 6 o'clock), a time zone (time located at 6 o'clock), a 24 hour display of the current time (located at 3 o'clock) and a chronograph (centre seconds completing one revolution of dial 6 in 30 seconds, and centre minutes completing one revolution of dial 6 in 60 minutes).

Advantageously, the chronograph and current time seconds are displayed by completing one revolution of the dial in 30 seconds so as to offer chronograph measurement precision of a tenth of a second. This precision is made possible owing to the high frequency of watch movement 5.

Moreover, this type of seconds display, i.e. one complete rotation of the seconds wheel of movement 5 achieved in 30 seconds, also simplifies the gear train. Indeed, the ratio between the seconds wheel and the escape wheel is thus divided by two which avoids the addition of an extra wheel set.

Advantageously according to the invention, watch movement 5 is capable of withstanding a frequency of more than 5 Hz, and notably a frequency of 10 Hz. To achieve this result, according to the invention, movement 5 preferably includes an escape system 7 whose inertia is attenuated by decreasing the mass thereof.

In the example illustrated in FIGS. 2 and 3, it can be seen that movement 5 includes a resonator 9 of the type with a balance 8 and balance spring 10 and an escape system 7 of the type with a wheel 11 and Swiss lever 13. These same FIGS. 2 and 3 show that balance 8 is of the variable inertia type, i.e. the four inertia-blocks 40 visible at the periphery of the felloe can be moved individually to adapt the inertia of the balance and, eventually, adjust movement 5. Balance 8 may, by way of example, be made of copper-beryllium alloy.

Balance spring 10 is preferably in a single piece with the collet 41, which is fitted onto the balance staff 12. In the example illustrated in FIGS. 2 and 3, the outer coil 42 of balance spring 10 is pinned up to the stud on a stationary part of movement 5 such as, for example, a bridge. As seen in FIG. 3, the inner coil 43 of balance spring 10 includes a Grossmann curve to compensate for the use of collet 41. By way of example, balance spring 10 may be formed from monocrystalline silicon and coated with silicon dioxide.

In the usual manner, resonator 9 cooperates with escape system 7 via a plate mounted on balance staff 12. Escape system 7, seen more clearly in FIGS. 4 to 6, includes a Swiss lever 13 formed by a projecting main face (seen in FIG. 6). Swiss lever 13 is mainly formed by a lever 14 connecting the fork 15 and the pallet arms 16, 17. Fork 15 includes two horns 18, 19 facing each other underneath which a dart 20 is mounted for cooperating respectively with a pin fixed to said plate of balance staff 12 and the low part of said plate.

Lever 14 receives, between the two pallet arms 16, 17, a shaft 21 intended for rotatably mounting Swiss lever 13 between a bridge and the bottom plate of movement 5. Finally, a pallet stone 22, 23, intended to enter into contact with escape wheel 11, is mounted on each arm 16, 17. Pallet stones 22, 23 may, by way of example, be formed of synthetic ruby.

Preferably, according to the invention, lever 14 and arms 16, 17 are pierced in order to reduce the inertia of escape system 7. Preferably, said projecting face (seen in FIG. 6) is pierced to obtain a surface density of less than 1 $mg.mm^{-2}$ and, depending upon the material used, a surface density reduced to 0.18 $mg.mm^{-2}$. To achieve this latter value, Swiss lever 13 may, by way of example, be formed from monocrystalline silicon coated with silicon dioxide.

It is clear that, if the thickness of arms 16, 17 and/or the lever is 0.1 mm of silicon, the inertia of the unequipped Swiss lever 13 may be as low as 0.75 $mg.mm^2$ and up to 2.85 $mg.mm^2$ when Swiss lever 13 is entirely fitted out, i.e. notably with ruby pallet stones 22, 23.

An additional coating may also be envisaged such as crystallised carbon in diamond-like-carbon (DLC) form at least on fork 15 so as to alter the tribology and/or mechanical features thereof.

Figure 4:
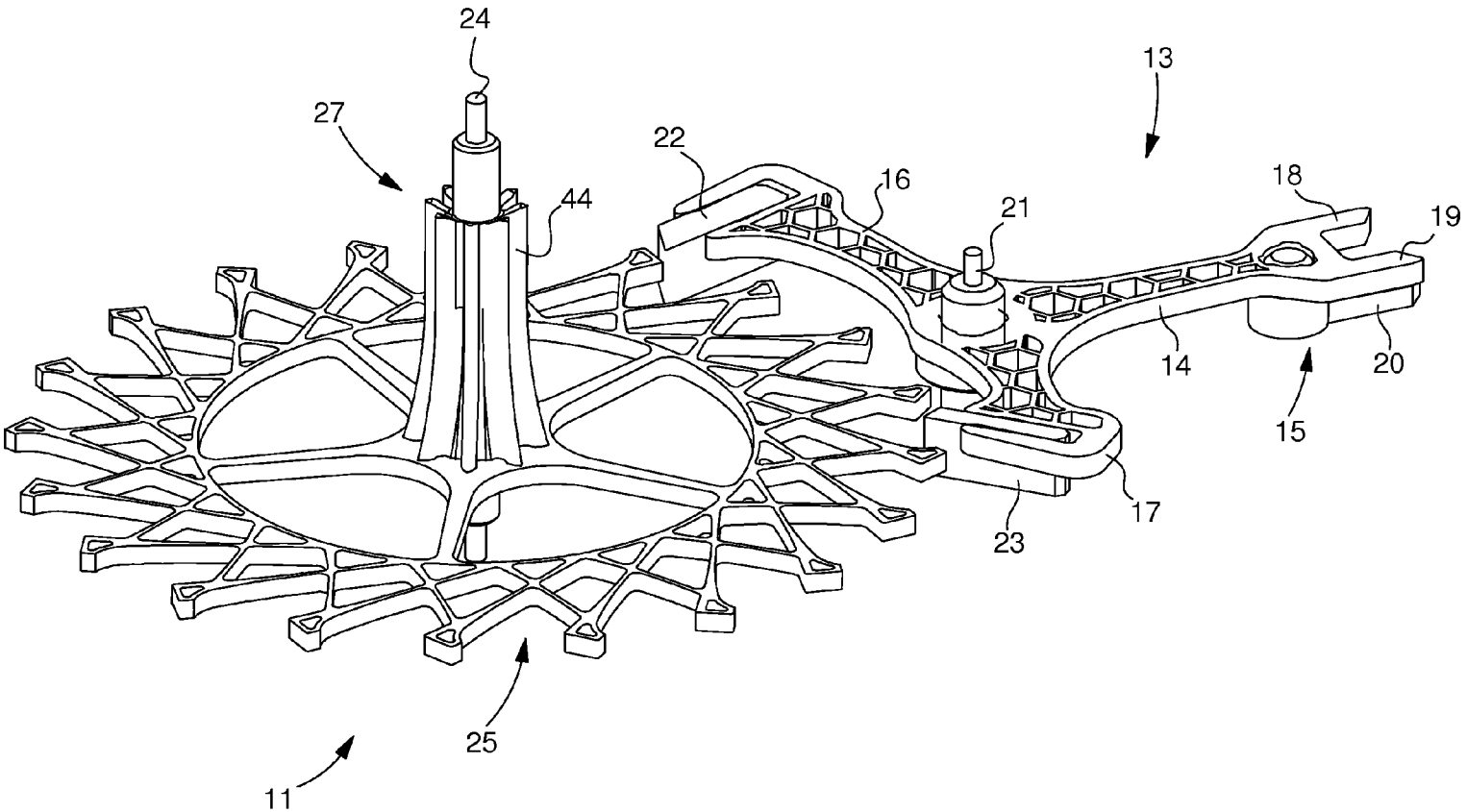
FIG. 4 is a perspective view of an escape system according to the invention.
Figure 5:
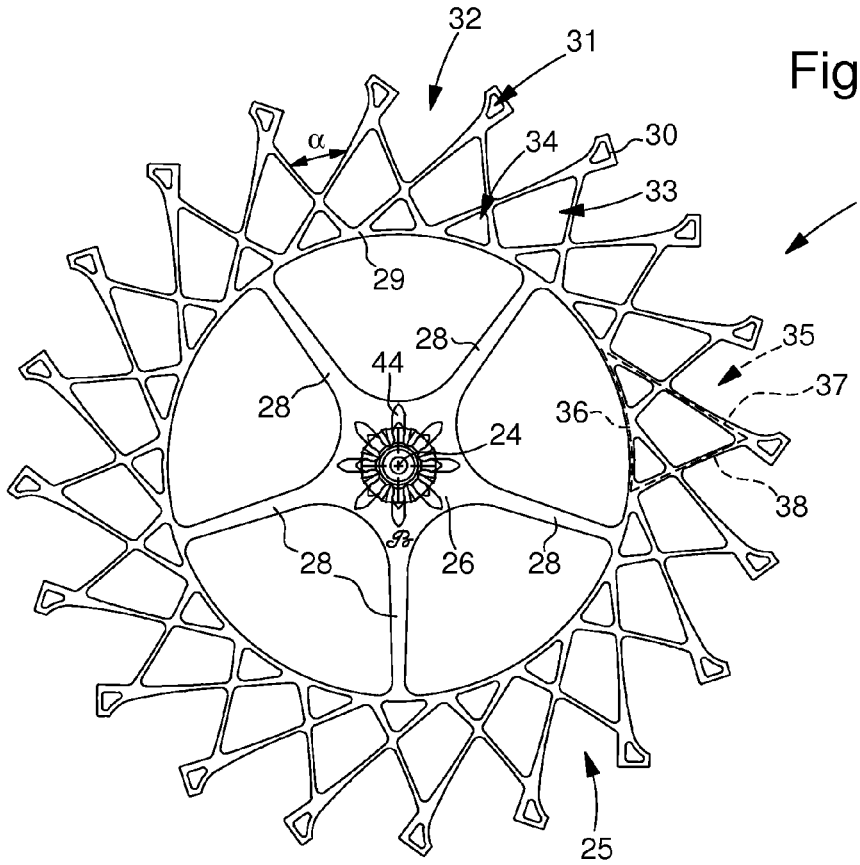
FIG. 5 is a top view of an escape wheel according to the invention.
Figure 6:
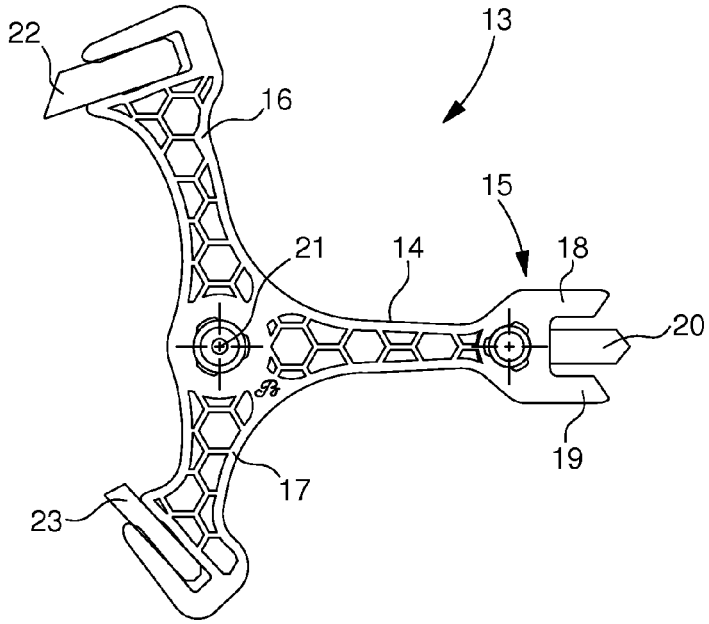
FIG. 6 is a top view of a Swiss lever according to the invention.

Finally, in the example illustrated in FIGS. 4 to 6, the piercing of lever 14 and arms 16, 17 preferably forms a honeycomb type structure so as to preserve the mechanical resistance of Swiss lever 13 while very considerably reducing the mass thereof.

Escape system 7 further includes an escape wheel 11, also formed by a projecting main face (seen in FIG. 5). Wheel 11 is formed in a plate 25 to which a pinion 27 is added via an arbour 24. Arbour 24 and pinion 27 may be integral with each other. As illustrated in FIGS. 4 and 5, pinion 27 includes eight symmetrical leaves 44 which gradually flare out as they get closer to plate 25 to make it easier to drive pinion 27 into wheel 11. Pinion 27 and arbour 24 may, for example, be formed of a metal or metal alloy like steel.

Plate 25 includes a hub 26 connected by five arms 28 to felloe 29, which includes twenty impulse teeth 30. Of course, the number of arms 28 and/or teeth 30 may vary. However, advantageously according to the invention, watch movement 5 can operate perfectly at a high frequency, i.e. for example at 10 Hz, with an escape wheel comprising twenty teeth 30.

According to the invention, felloe 29 and/or teeth 30 are pierced to decrease the inertia of escape system 7. Preferably, the piercing of said projecting main face (seen in FIG. 5) provides a surface density of less than 0.7 $mg.mm^{-2}$ and, depending upon the material used, a surface density as low as 0.16 $mg.mm^{-2}$. To achieve this latter value, board 25 may, by way of example, be formed from monocrystalline silicon and coated with silicon dioxide.

It is thus clear that, if the thickness of board 25 is 0.12 mm, the inertia of escape wheel 11 may be as low as 1.59 $mg.mm^2$.

An additional coating may also be envisaged, such as crystallised carbon in the form of diamond-like-carbon (DLC), at least for teeth 30 so as to alter the tribology and/or mechanical features thereof.

Recess 31 of teeth 30 is substantially triangular in the example illustrated in FIG. 5, however it is of course possible for the recess to have a different shape.

Felloe 29 is pierced with spaces 32 between teeth 30 which are amplified to form an acute angle $\alpha$. Moreover, from each tooth 30 towards hub 26, felloe 29 includes quadrilateral shaped recesses 33, and between each recess 33, substantially triangular piercings 34.

As illustrated in dotted lines in FIG. 5, frame 35 carrying each tooth 30 is thus triangular, base 36 being formed by the inner diameter of felloe 29 and connecting the tooth 30 associated therewith via two substantially rectilinear sides 37, 38.

In the example illustrated in FIG. 5, each frame 35 thus includes a recess 33 and two piercings 34. Further, each frame 35 is imbricated with the other two adjacent frames 35. Thus, each frame 35 includes a side 37 secant with the side 38 of the preceding frame and a side 38 secant with the side 37 of the following frame. Finally, the side 38 of the preceding frame joins the side 37 of the following frame substantially in the middle of base 36 of frame 35. This architecture of board 25 decreases its mass significantly while maintaining its mechanical properties.

Consequently, advantageously according to the invention, because of the aforementioned adaptation of its escape system 7, watch movement 5 is capable of withstanding a frequency of more than 5 Hz and notably a frequency of 10 Hz.

Of course, this invention is not limited to the illustrated example but is capable of various variants and alterations that will appear to those skilled in the art. In particular, each of the piercings 31, 32, 33, 34 made in plate 25 or in Swiss lever 13 can be shaped differently and/or distributed differently and/or not be a through piercing and/or not shaped depending upon the application.

Evidently the elementary surface of at least one element, for example 11, 13 could be projected in a non-identical thickness, i.e. for example, the thickness of board 25, each arm 16, 17 or lever 14 could be variable or non identical to the others.

Further, the materials cited by way of example for each element may also be adapted in accordance with the application and/or if new or other materials are particularly well matched.

What is claimed is:

1. A timepiece comprising:

(a) a movement that has a resonator with a balance and balance spring; and (b) an escape system with a wheel and Swiss lever, wherein the balance oscillates at more than 36,000 vibrations per hour, wherein the escape system is at least partially pierced so as to reduce the inertia thereof, and wherein the escape system includes an escape wheel with less than 25 teeth.

2. The timepiece according to claim 1, wherein the balance oscillates at 72,000 vibrations per hour.

3. The timepiece according to claim 1, wherein the wheel of the escape system includes a projecting main face with a surface density is less than 0.7 $mg.mm^{-2}$.

4. The timepiece according to claim 1, wherein a toothing of the wheel is pierced.

5. The timepiece according to claim 1, wherein a felloe of the wheel is pierced.

6. A timepiece comprising:

(a) a movement that has a resonator with a balance and balance spring; and (b) an escape system with a wheel and Swiss lever, wherein the balance oscillates at more than 36,000 vibrations per hour, wherein the escape system is at least partially pierced so as to reduce the inertia thereof, wherein the escape system includes an escape wheel with less than 25 teeth, wherein a felloe of the wheel is pierced, and wherein the pierced wheel forms frames that each carry a tooth and are substantially triangular, wherein a base of the frame is formed by the inner diameter of the felloe and wherein the base connects the tooth associated therewith by two sides.

7. The timepiece according to claim 6, wherein each frame is imbricated with the other two adjacent frames.

8. The timepiece according to claim 7, wherein each frame has a first side and a second side, and wherein the first side of the two sides of each frame is secant with the second side of a preceding frame and the second side thereof is secant with the first side of following frame.

9. The timepiece according to claim 8, wherein the second side of the preceding frame joins the first side of the following frame substantially in a middle of the base of the frame.

10. The timepiece according to claim 6, wherein each frame surrounds a substantially quadrilateral shaped recess and two substantially triangular piercings.

11. The timepiece according to claim 1, wherein the wheel of the escape system includes twenty teeth.

12. The timepiece according to claim 1, wherein the wheel is formed from monocrystalline silicon coated with silicon dioxide.

13. The timepiece according to claim 1, wherein the Swiss lever of the escape system includes a projecting main face with a surface mass is less than 1 $mg.mm^{-2}$.

14. The timepiece according to claim 1, wherein the Swiss lever is pierced forming a honeycomb-type structure so as to preserve the mechanical resistance thereof.

15. The timepiece according to claim 1, wherein the Swiss lever is formed from monocrystalline silicon coated with silicon dioxide.

16. The timepiece according to claim 1, wherein at least one part of the escape system includes an outer coating so as to alter a tribology or mechanical features or the tribology and mechanical features thereof.

17. The timepiece according to claim 1, wherein the balance is a variable inertia type balance.

18. The timepiece according to claim 1, wherein a seconds wheel of the movement is mounted to complete one revolution in 30 seconds in order to simplify the gear train of the movement.

* * * * *